US005133400A

United States Patent [19]

Bethge

[11] Patent Number: 5,133,400

[45] Date of Patent: Jul. 28, 1992

[54] APPARATUS FOR ROTATING AND MOVING AN INGOT MOLD TABLE IN A VACUUM MELTING AND CASTING UNIT

[75] Inventor: Daniel Bethge, Rodenbach, Fed. Rep. of Germany

[73] Assignee: Leybold Aktiengesellschaft, Hanau, Fed. Rep. of Germany

[21] Appl. No.: 654,119

[22] Filed: Feb. 11, 1991

[30] Foreign Application Priority Data

Dec. 4, 1990 [DE] Fed. Rep. of Germany ..... 4038576

[51] Int. Cl.[5] ..... B22D 18/06

[52] U.S. Cl. ..... 164/258; 164/323; 198/375; 414/196; 414/217

[58] Field of Search ..... 164/256, 258, 323; 198/375; 414/196, 217

[56] References Cited

U.S. PATENT DOCUMENTS

| | | | |
|---|---|---|---|
| 3,185,565 | 5/1965 | Taylor | 164/256 X |
| 3,601,179 | 8/1971 | Taylor | 164/258 X |
| 3,687,191 | 8/1972 | Hulit et al. | 164/258 |

FOREIGN PATENT DOCUMENTS

| | | | |
|---|---|---|---|
| 1143606 | 2/1963 | Fed. Rep. of Germany | 164/256 |
| 1214359 | 4/1966 | Fed. Rep. of Germany | 164/258 |
| 1253872 | 11/1967 | Fed. Rep. of Germany . | |
| 414955 | 12/1966 | Switzerland . | |
| 486863 | 1/1976 | U.S.S.R. | 164/256 |
| 1357124 | 12/1987 | U.S.S.R. | 164/258 |
| 1025072 | 4/1966 | United Kingdom | 164/258 |
| 1230565 | 5/1971 | United Kingdom | 164/256 |

*Primary Examiner*—J. Reed Batten, Jr.
*Attorney, Agent, or Firm*—Felfe & Lynch

[57] ABSTRACT

A mold table is linearly moved into a pouring position or a resting position in a vacuum casting unit and rotates around its vertical axis so that the ingot molds disposed on the mold table can be individually positioned in front of the pouring nose of a crucible. A flexible belt-type roller device, for example a roller chain 15 as used in the chain drive of a crawler, is guided around a rod-like carrier 13 disposed in direction F in the mold chamber, and a catch 16 is integrated into this flexible, belt-type device. A separate drive, preferably a rope drive, is provided for moving the apparatus 10, this drive being connected to the rotatable catch 16 generating the rotation of the mold table. All motors for linearly moving and rotating the mold table are disposed outside the vacuum chamber.

12 Claims, 3 Drawing Sheets

APPARATUS FOR ROTATING AND MOVING AN INGOT MOLD TABLE IN A VACUUM MELTING AND CASTING UNIT

BACKGROUND OF THE INVENTION

The invention concerns an apparatus for rotating and moving an ingot mold table in a vacuum melting and casting unit. On the one hand, the mold table can be linearly moved into a pouring position or a resting position and, on the other hand, it can be rotated around its vertical axis. Each of the molds, which are disposed on the table, can thus be positioned in front of the pouring nose of a crucible and all motors to drive the rotating and moving apparatus are provided outside the vacuum chamber.

Vacuum melting and casting units are known where the mold table can be rotated and moved exclusively by separate devices (Leybold prospectus 31-200.01 and 31.220.1/2).

In these publications, the molds stand on a mold table, also referred to as a rotary table, that is usually rotatably supported in a movable mold chamber. The rotary table is driven by a motor attached on the outside at the bottom of the mold chamber. The mold chamber itself is moved by sets of wheels provided on the outside of the chamber with at least one set of wheels being driven.

Also, other rotating and moving apparatus have been designed where the mold table is moved inside a stationary mold chamber by means of a chain hoist or a roller system, for example.

All these known vacuum melting and casting units inclusive of the conventional rotating and moving devices for mold tables have the disadvantage of being very large. This means that (1) their manufacture involves a great amount of labor and cost, and (2) due to the large chamber volumes, their method of operation is slow and hence not economical.

SUMMARY OF THE INVENTION

The present invention hence addresses the task of developing a rotating and moving apparatus for mold tables which fulfills the new requirements for vacuum melting and casting units. The apparatus is hence of a smaller and more compact design, is driven by "external" motors and its manufacture and operation are less expensive.

This object is accomplished in accordance with the invention in that a. in order to drive the apparatus, a flexible belt-type drive device, for example a roller chain similar to the type used in crawlers is guided around a rod-shaped carrier disposed in direction of moving and in that a catch is integrated in the flexible belt-type device (roller chain) which, for the purpose of transportation, positively engages the mold table and in that b. in order to rotate the apparatus, provision is preferably made for a rope drive to be connected to the rotatable catch thus producing a rotation of the mold table.

The rotating and moving apparatus is equipped with a flexible belt-type device, for example a roller chain, which advantageously permits covering a distance that corresponds to twice the length of the apparatus. The speed of travel of the catch that is connected to the mold table corresponds to twice the speed of the moving apparatus.

DETAILED DESCRIPTION OF THE PREFERRED EMBODIMENT

Figure 1:
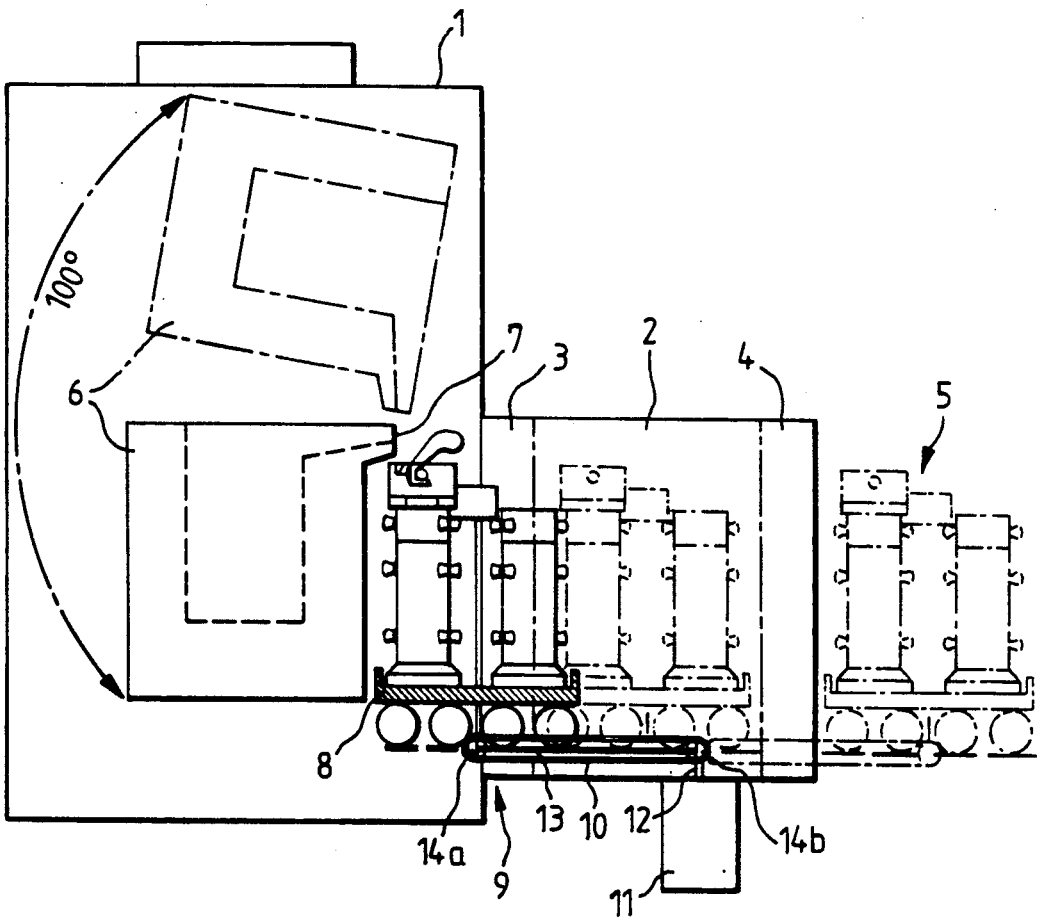
FIG. 1 is a section of a part of a vacuum melting and casting unit, essentially comprising a melting and mold chamber including components built therein.

FIG. 1 shows a vacuum melting and casting chamber 1 of rectangular shape with an also rectangular mold chamber 2 connected to its side. Chambers 1 and 2 are separated by a gate 3, and another gate 4 closes the side of the mold chamber 2 which is opposite gate 3. Subsequently thereto is the feeding station 5 for the mold.

A cylindrical crucible 6 having a pouring nose 7 is rotatably disposed in the vacuum chamber 1 such that it can be swung out of the vertical axis by 100° (broken lines).

At the mold feeding station 5, represented in broken lines, a mold table 8 which has rollers and can be rotated around its vertical axis is fed with upright, cylindrical ingots and moved into a casting position across the evacuable mold chamber 2 so that the two halves of the mold table 8 come to a halt in chambers 1 and 2, respectively.

The mold table 8 is placed on top of a rotating and moving apparatus 10 driven by a motor 11. An axle 12 traversing the bottom of the chamber connects apparatus 10 to drive motor 11.

The moving apparatus 10 moves in a horizontal direction with the distance covered corresponding to twice the length of carrier 13. This allows reaching the following two extreme positions:

1. The rotating and moving apparatus 10 has reached a stop in the melting and casting chamber 1 in pouring position 9.

2. The rotating and moving apparatus 10 has reached a stop in the ingot and feeding station 5 outside the mold chamber 2 (broken lines).

Figure 2:
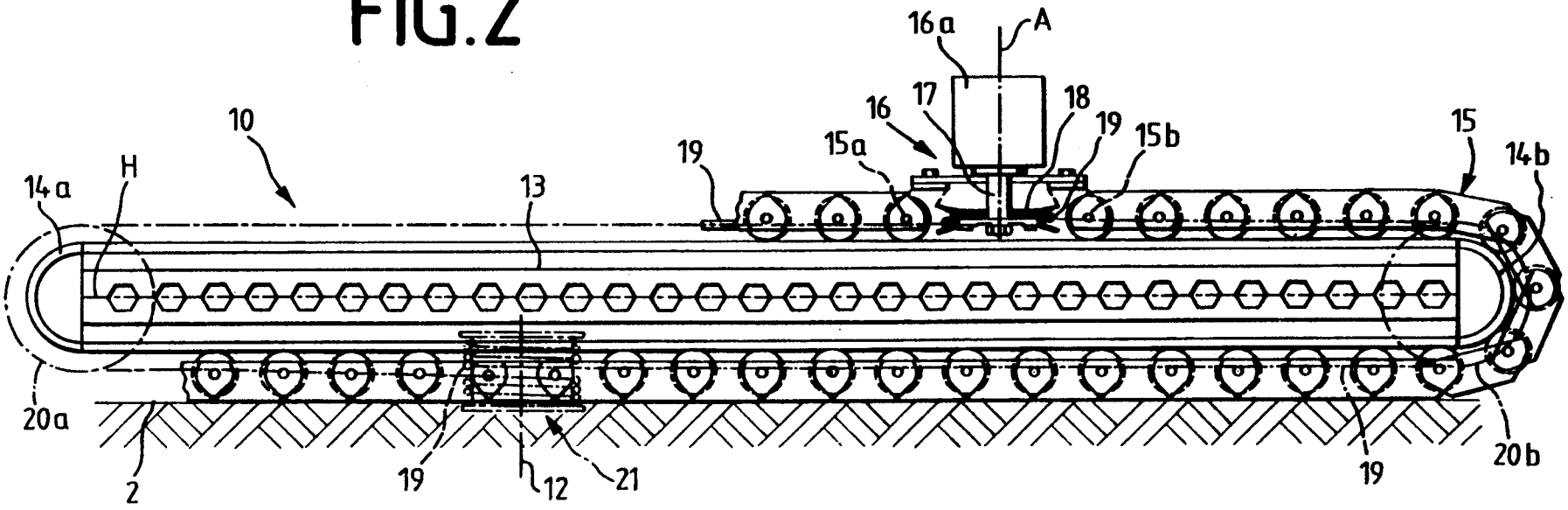
FIG. 2 is an enlarged side view of a rotating and moving apparatus for a mold table.

As seen in FIG. 2, the rotating and moving apparatus 10 essentially comprises a central carrier 13 having an I-section, each of the two ends thereof having a semicircular redirecting zone **14*a*, 14*b*. Further, it includes a roller chain 15 surrounding these components 13, 14*a*, 14*b* such that the entire rotating and moving apparatus 10 can be moved like a crawler. The moving distance, however, is limited since the chain 15 is attached in direct vicinity to drive 12 at the bottom of chamber 2. A not represented attachment integrates the catch 16, which engages the movable and rotatable mold table 8 via cubic body 16*a*, in the roller chain 15 such that this catch 16, together with chain 15, can still be moved over the entire length of carrier 13**. On the other hand, it can be rotated around its vertical axis A. Both movements can be executed individually or together.

A shaft 17 connects the catch 16 in axial direction A to a rope pulley 18 which is form-fittingly surrounded by a rope 19.

Each of the two ends of rope 19 is redirected by 180° via two rope pulleys **20*a*, 20*b* and in several windings placed around the rope drive drum 21 and fastened such that as soon as the drum 21 is set into rotation by a not represented drive, one end of rope 19 is wound onto drum 21 and the other end is wound off. Since the catch 16 is rigidly mounted between the two rollers 15***a* and 15*b*, rope 19, running around pulley 18 in a form-fitting engagement, rotates the catch 16 around the axis A thereof.

Figure 4:
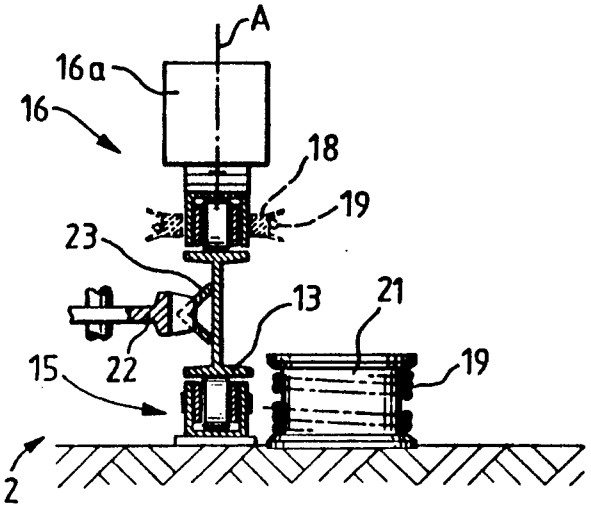
FIG. 4 is an enlarged sectional view of the drive elements.
Figure 3:
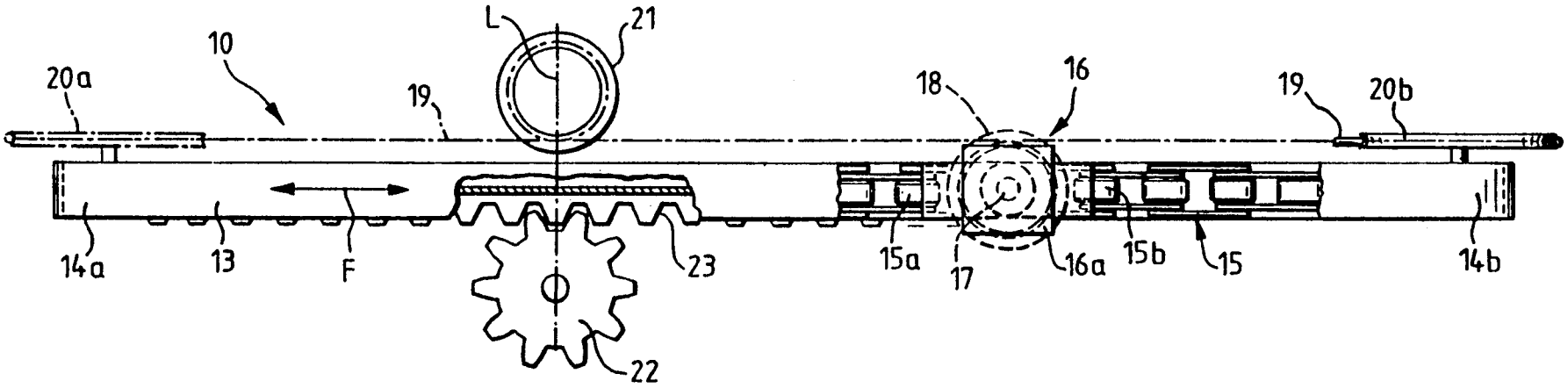
FIG. 3 is a top view of the rotating and moving apparatus of FIG. 2.

A pinion 22 (FIGS. 3 and 4) is located on a common line of connection L with the rope drive drum 21. This line L extends transversely to the direction of moving F of apparatus 10 with the pinion 22 and drum 21 being disposed on opposite sides of carrier 13 (FIGS. 3 and 4).

The rotating and moving apparatus 10 is driven by means of drive motor 11 (FIG. 1) which is connected to the toothed wheel 22 mounted to the bottom of the chamber. The driving pinion 22 meshes with a toothed rack 23 which is integrated into carrier 13 and extends over the entire length of this carrier 13. The rotation of pinion 22 moves the entire rotating and moving apparatus 10 in direction F.

I claim:

1. Apparatus for linearly moving a mold table into a vacuum melting and casting unit and rotating said table in said unit so that ingot molds disposed on the table can be individually positioned under the pouring nose of a crucible, comprising a carrier arranged for linear movement relative to said casting unit, said mold table being mounted for rotation about a vertical axis relative to said carrier, belt-type roller means guided around said carrier to permit said linear movement, first drive means for moving said carrier linearly relative to said casting unit, rotatable catch means integrated into said belt-type roller means for rotating said mold table relative to said carrier, and second drive means for rotating said catch means, said second drive means comprising rope means connected to said rotatable catch means.

2. Apparatus as in claim 1 wherein said first drive means comprises a driven pinion remote from said casting unit and rack means fixed relative to said carrier.

3. Apparatus as in claim 1 wherein said rotatable catch means comprises a cubic body, a shaft, and a pulley, said rope means being connected to said pulley.

4. Apparatus as in claim 3 wherein said shaft has a vertical axis of rotation and said carrier is arranged for horizontal movement.

5. Apparatus as in claim 3 wherein said cubic body is situated above said belt type roller means.

6. Apparatus as in claim 3 wherein said cubic body and said pulley are fixed to said shaft and have a common vertical axis of rotation.

7. Apparatus as in claim 1 wherein said second drive means further comprises a driven drum remote from said casting unit, said rope means connecting said driven drum to said catch means.

8. Apparatus as in claim 7 wherein said driven drum has a vertical axis of rotation.

9. Apparatus as in claim 8 wherein said first drive means comprises a driven pinion having a vertical axis of rotation, said pinion axis and said drum axis being located on opposite sides of said carrier relative to its direction of linear movement.

10. Apparatus as in claim 7 wherein said rope means has several windings about said drum.

11. Apparatus as in claim 3 wherein said rope means has one full winding about said pulley.

12. Apparatus as in claim 1 wherein said first and second drive means are independently controlled.

* * * * *